US010248057B2

(12) United States Patent
Uchida

(10) Patent No.: US 10,248,057 B2
(45) Date of Patent: Apr. 2, 2019

(54) FIXING DEVICE

(71) Applicant: BROTHER KOGYO KABUSHIKI KAISHA, Nagoya-shi, Aichi-ken (JP)

(72) Inventor: Norio Uchida, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/461,801

(22) Filed: Mar. 17, 2017

(65) Prior Publication Data

US 2017/0285539 A1 Oct. 5, 2017

(30) Foreign Application Priority Data

Mar. 31, 2016 (JP) ..... 2016-070189

(51) Int. Cl.
*G03G 15/20* (2006.01)

(52) U.S. Cl.
CPC ..... *G03G 15/2053* (2013.01); *G03G 15/2057* (2013.01); *G03G 2215/2035* (2013.01)

(58) Field of Classification Search
CPC ..... G03G 15/2053
See application file for complete search history.

(56) References Cited

U.S. PATENT DOCUMENTS

2010/0202809 A1* 8/2010 Shinshi ..... G03G 15/2064 399/329

FOREIGN PATENT DOCUMENTS

| | | |
|---|---|---|
| JP | 2010-181821 A | 8/2010 |
| JP | 2013-214039 A | 10/2013 |
| JP | 2014-145858 A | 8/2014 |

* cited by examiner

*Primary Examiner* — David M. Gray
*Assistant Examiner* — Michael A Harrison
(74) *Attorney, Agent, or Firm* — Merchant & Gould P.C.

(57) ABSTRACT

A fixing device comprising: an endless belt; a roller being in contact with an outer surface of the endless belt; a nip plate disposed in the endless belt; a supporting member disposed in the endless belt; a spring member disposed in the endless belt between the nip plate and the supporting member, the spring member urged in a first direction away from the nip plate toward the supporting member; and a sliding sheet having a first surface and a second surface. The sliding sheet is nipped with the endless belt between the nip plate and the roller, the first surface is in contact with an inner surface of the endless belt and the second surface is in contact with the nip plate. The sliding sheet is fastened to a facing surface of the spring member that is facing toward the supporting member, and the second surface contacts the spring member.

20 Claims, 9 Drawing Sheets

FIXING DEVICE

CROSS-REFERENCE TO RELATED APPLICATION

This application claims priority from Japanese Patent Application No. 2016-070189 filed on Mar. 31, 2016, the content of which is incorporated herein by reference in its entirety.

TECHNICAL FIELD

Aspects disclosed herein relate to a fixing device.

BACKGROUND

Belt-fixing type fixing devices have been known as fixing devices that are included in, for example, printers or copying machines, and that fix a toner image onto a sheet by heating the sheet. Some fixing device includes a belt, a nip member, a sliding sheet, and a fastening member. The nip member is disposed inside a loop of the belt. The sliding sheet is sandwiched between the belt and the nip member. The fastening member is disposed opposite to the belt relative to the nip member. In such a fixing device, end portions of the sliding sheet in a circumferential direction of the belt are fastened to the fastening member by elastic force of plate springs.

SUMMARY

The sliding sheet may be used for reducing sliding resistance occurring at a fixing nip area during rotation of the belt, and may have a contact surface that may contact an inner circumferential surface of the belt. Therefore, the sliding sheet may be configured such that a frictional force to be caused by sliding of the contact surface of the sliding sheet relative to the inner circumferential surface of the belt is smaller than a frictional force to be caused by sliding of the sliding sheet relative to a surface of the nip member. Nevertheless, the frictional force of the contact surface of the sliding sheet relative to the inner circumferential surface of the belt may increase due to long-term usage of the fixing device. The increase of the frictional force may further cause increase of a force pulling the sliding sheet along the circumferential direction of the belt. In the known fixing device, the sliding sheet may be fastened to the fastening member while the both end portions of the sliding sheet in the circumferential direction of the belt are pressed by the elastic force of the plate springs. Nevertheless, this configuration may let one of the end portions of the sliding sheet, more specifically, for example, the upstream end portion of the sliding sheet in a belt rotating direction, slip off from between the plate springs and the fastening member. In another case, the sliding sheet may have been stretched due to pulling of the sliding sheet in the belt rotating direction, and become larger than the original size. In a state where the sliding sheet has become larger, when the nip of the belt at the fixing nip area is released and the belt is nipped again at the fixing nip area, the sliding sheet may crease or wrinkle at its portion sandwiched between the nip member and the belt.

Accordingly, some embodiments of the disclosure provide for a technique for solving at least one of the above-described problems.

According to one aspect, there is provided a fixing device comprising: an endless belt; a roller being in contact with an outer surface of the endless belt; a nip plate disposed in the endless belt; a supporting member disposed in the endless belt and supporting the nip plate; a spring member disposed in the endless belt between the nip plate and the supporting member, the spring member urged in a first direction away from the nip plate toward the supporting member; and a sliding sheet having a first surface and a second surface opposite the first surface, the sliding sheet is nipped with the endless belt between the nip plate and the roller, the first surface is in contact with an inner surface of the endless belt and the second surface of the sliding sheet is in contact with the nip plate. The sliding sheet is fastened to a facing surface of the spring member that is facing toward the supporting member and away from the nip plate, and the second surface contacts the spring member.

According to another aspect, there is provided a fixing device comprising: an endless belt, a roller being in contact with an outer surface of the endless belt, a nip plate disposed in the endless belt, a supporting member supporting the nip plate, a plate portion located between the nip plate and the supporting member, a spring portion urging the plate portion in a first direction away from the nip plate toward the supporting member, and a sliding sheet being in contact with an inner surface of the endless belt and nipped with the endless belt between the nip plate and the roller, the sliding sheet being fastened to the plate portion.

The technique disclosed in the disclosure may be implemented by various manners, for example, may be implemented in fixing devices or image forming apparatuses including fixing devices.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Figure 1:
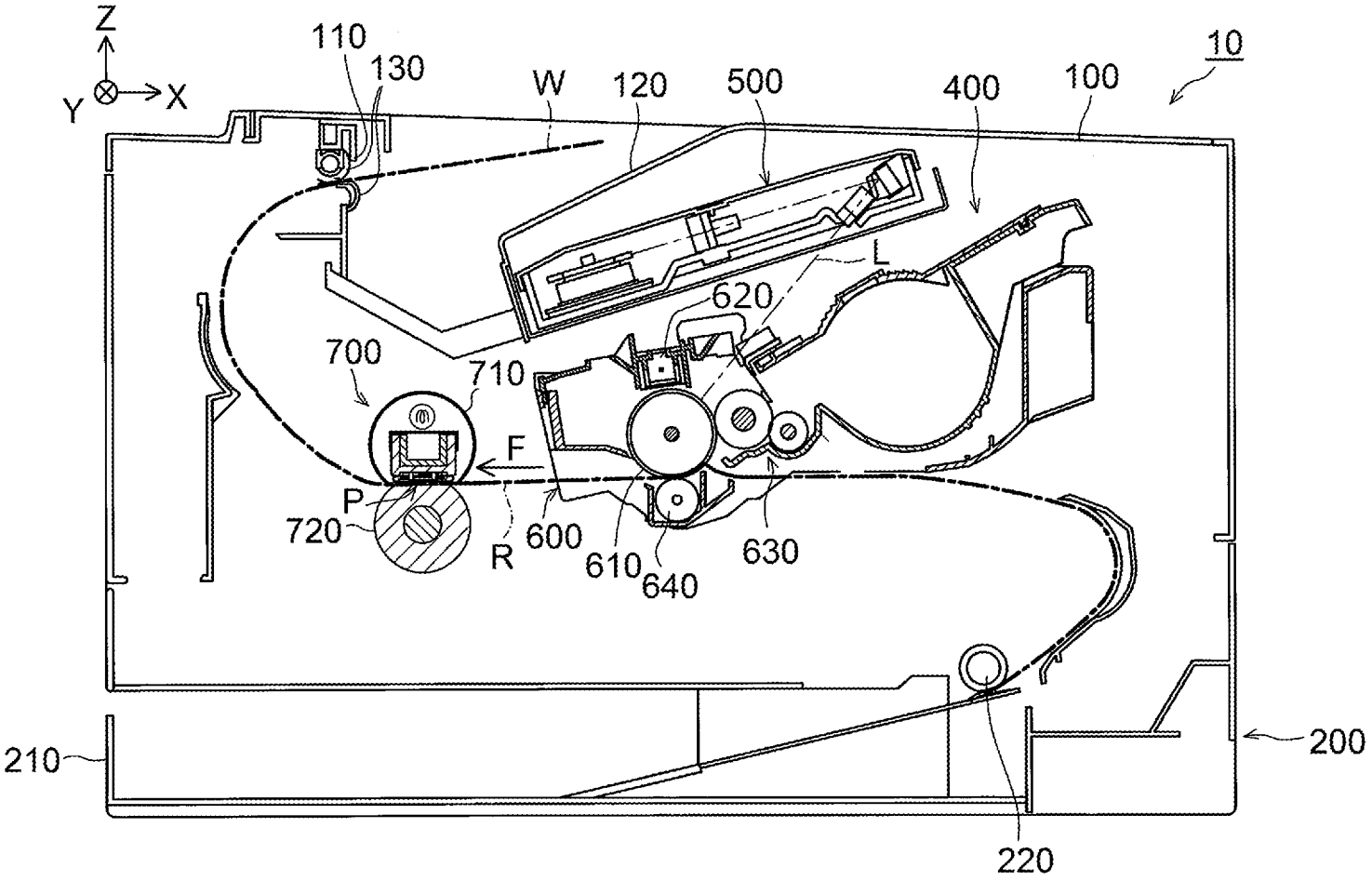
FIG. 1 is a schematic diagram illustrating an overall configuration of a printer in an illustrative embodiment according to one or more aspects of the disclosure.

Hereinafter, a printer 10 according to an illustrative embodiment will be described. FIG. 1 is a schematic diagram illustrating an overall configuration of the printer 10. In FIG. 1, X, Y, and Z axes orthogonal to each other are indicated for defining directions. The X axis may extend in a front-rear direction with respect to the printer 10 and may extend along a sheet conveyance direction F. The Y axis may extend in a right-left direction with respect to the printer 10 and may extend along a width direction Y. The Z axis may extend in a top-bottom direction with respect to the printer 10 and may extend along a pressing direction N. The printer 10 may be an electrophotographic printer configured to form an image onto a sheet W, e.g., a recording sheet or an overhead projector sheet, using toner (e.g., developer) of a single color (e.g., black). The printer 10 is an example of an image forming apparatus.

As illustrated in FIG. 1, the printer 10 includes a housing 100, a sheet feeding unit 200 and an image forming unit 400. The housing 100 accommodates therein the sheet feeding unit 200 and the image forming unit 400. The housing 100 has a discharge port 110 and a discharge tray 120 defined in an upper portion thereof. The printer 10 further includes discharge rollers 130 that are disposed at the discharge port 110 of the housing 100.

The sheet feeding unit 200 includes a tray 210 and a pickup roller 220. The tray 210 is configured to accommodate one or more sheets W therein. The pickup roller 220 picks up, one by one, the one or more sheets W accommodated in the tray 210 and to feed the picked sheet W toward the image forming unit 400.

The image forming unit 400 includes an exposure unit 500, a process unit 600, and a fixing device 700. The exposure unit 500 irradiates a surface of a photosensitive drum 610 of the process unit 600 with laser light L (e.g., a light beam).

The process unit 600 includes the photosensitive drum 610, a charger 620, a developing unit 630, and a transfer roller 640. The charger 620 charges the surface of the photosensitive drum 610 uniformly. Subsequent to charging of the surface of the photosensitive drum 610 by the charger 620, the exposure unit 500 irradiates the surface of the photosensitive drum 610 with laser light L to form an electrostatic latent image thereon. Then, the developing unit 630 supplies toner onto the surface of the photosensitive drum 610 to develop the electrostatic latent image, and thus, a toner image is formed thereon. The toner image is then transferred onto a sheet W by the transfer roller 640 while the sheet W passes between the photosensitive drum 610 and the transfer roller 640.

The fixing device 700 fixes the toner image transferred onto the sheet W thereon by applying heat to the sheet W that has passed the process unit 600. Thus, an image is formed on the sheet W. The discharge rollers 130 discharge the sheet W that has passed the fixing device 700, onto the discharge tray 120 via the discharge port 110. Hereinafter, a path through which a sheet W is conveyed from the sheet feeding unit 200 to the discharge rollers 130 is referred to as a conveyance path R, and a direction that a sheet W moves at the fixing device 700 along the conveyance path R is referred to as a sheet conveyance direction F. More specifically, for example, a direction extending from a position where a sheet W enters a nip portion P of the fixing device 700 toward a position where the sheet W exits from the nip portion P of the fixing device 700 is referred to as the sheet conveyance direction F. The sheet conveyance direction F extends along the X axis.

Figure 2:
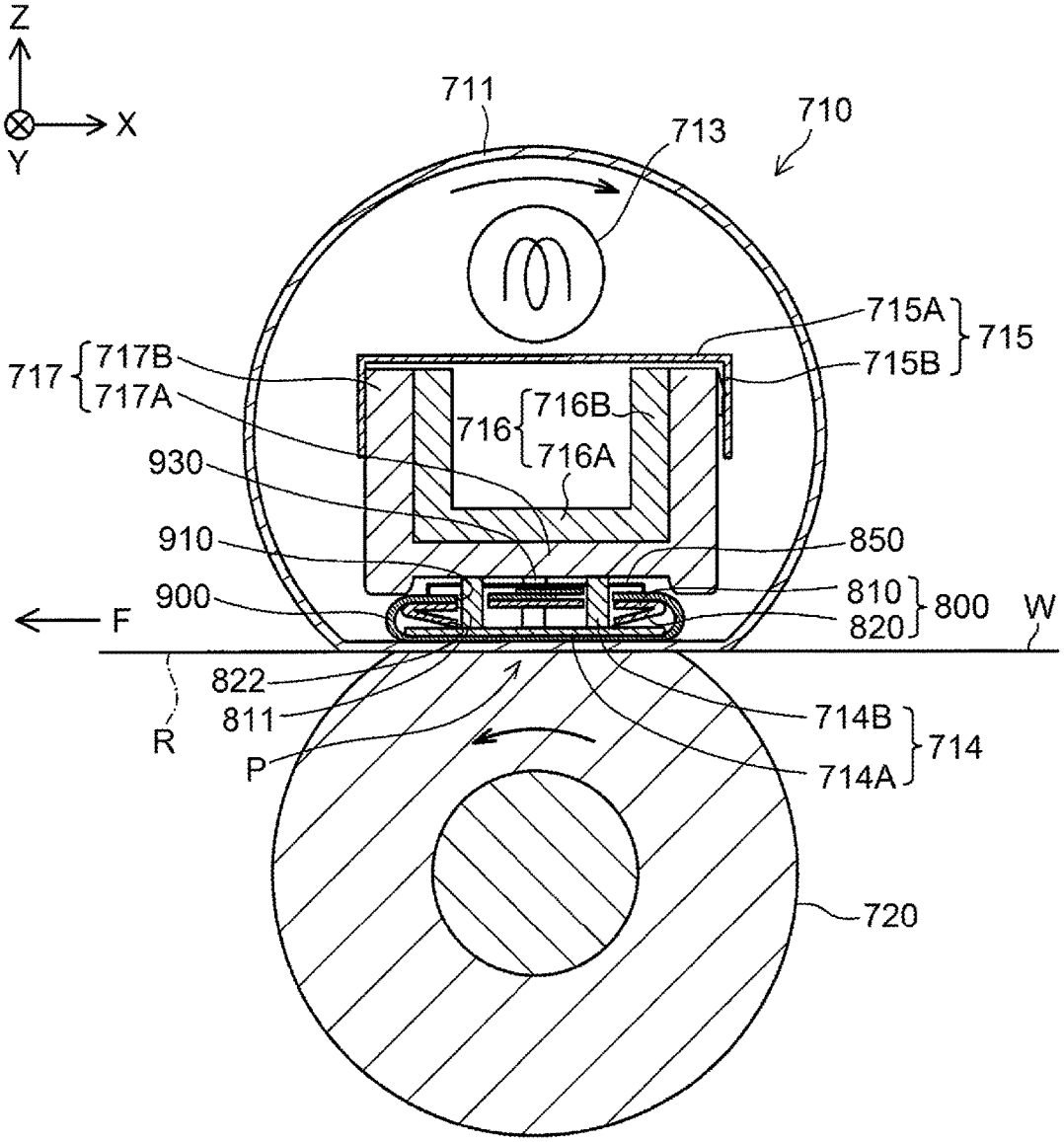
FIG. 2 is a side sectional view illustrating an X-Z section configuration of a fixing device in the illustrative embodiment according to one or more aspects of the disclosure.

FIG. 2 is a schematic diagram illustrating a configuration of the fixing device 700. FIG. 2 also illustrates an X-Z section configuration of a nip member 714, a plate spring 800, a sliding sheet 900, and one of retainers 850 taken along line II-II of FIG. 5. As illustrated in FIG. 2, the fixing device 700 includes a rotary heating unit 710 and a rotary pressure-application member 720.

The rotary heating unit 710 may have a cylindrical shape and is long in the width direction Y orthogonal to the sheet conveyance direction F. The width direction Y extends along the Y axis. The rotary pressure-application member 720 may be a roller rotatable on an axis extending substantially parallel to the width direction Y. The rotary pressure-application member 720 is pressed toward the rotary heating unit 710 and thus the rotary heating unit 710 and the rotary pressure-application member 720 form the nip portion P therebetween. The rotary pressure-application member 720 is an example of a backup member. The rotary heating unit 710 and the rotary pressure-application member 720 are disposed one above the other in a direction extending parallel to the Z axis. Hereinafter, a direction from the rotary pressure-application member 720 toward the rotary heating unit 710 is referred to as the pressing direction N. More specifically, the pressing direction N may be orthogonal to both the sheet conveyance direction F and the width direction Y and may extend along the Z axis. A relatively upstream side in the pressing direction N may be referred to as "above" or "upward", and a relatively downstream side in the pressing direction N may be referred to as "below" or "downward".

The rotary heating unit 710 includes a fixing belt 711, a halogen heater 713, the nip member 714, a reflector 715, a stay 716, a heat insulator 717, the plate spring 800, the sliding sheet 900, and the retainers 850. Each of the stay 716 and the heat insulator 717 is an example of a supporting member.

The fixing belt 711 may be an annular belt having a width along the width direction Y. The fixing belt 711 is configured to rotate on an axis extending along the width direction Y. The fixing belt 711 may be made of metal, for example, stainless steel or nickel. The halogen heater 713 may have a rod-like shape that is long in the width direction Y. The halogen heater 713 is configured to generate heat by application of power from an alternating-current power supply (not illustrated). The halogen heater 713 is disposed inside a loop of the fixing belt 711 while being spaced apart from an inner circumferential surface of the fixing belt 711. The fixing belt 711 is an example of an endless belt. The halogen heater 713 is an example of a heater.

Figure 3:
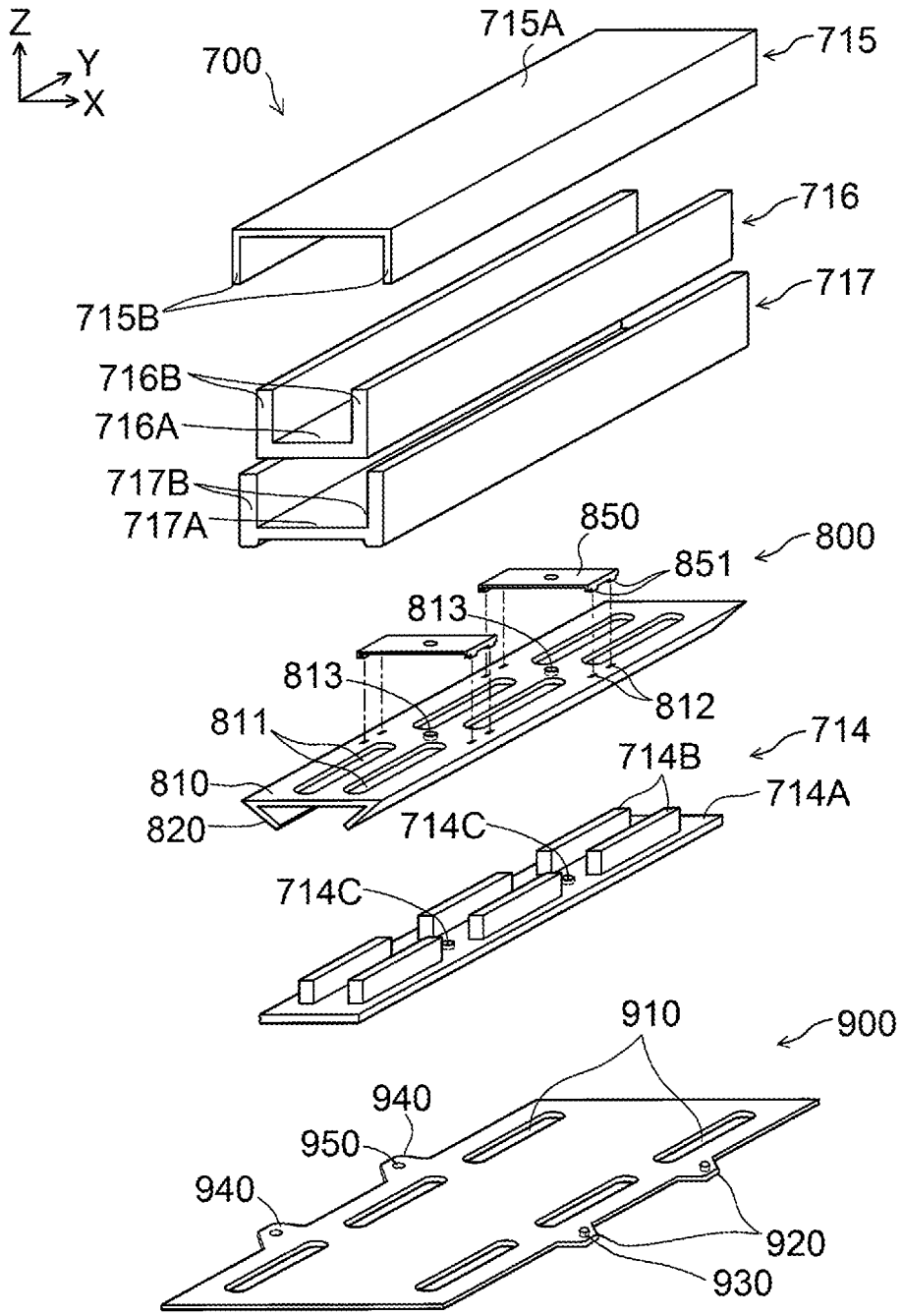
FIG. 3 is a disassembled perspective view illustrating the fixing device including a sliding sheet, a nip member, a plate spring, a heat insulator, a stay, and a reflector in the illustrative embodiment according to one or more aspects of the disclosure.

FIG. 3 is a disassembled perspective view illustrating the fixing device 700 including the nip member 714, the reflector 715, the stay 716, the heat insulator 717, the plate spring 800, the sliding sheet 900, and the retainers 850. As illustrated in FIGS. 2 and 3, the reflector 715 is disposed inside the loop of the fixing belt 711 while being spaced apart from the halogen heater 713. The reflector 715 has longer sides extending in the width direction Y and includes a flat portion 715A and flange portions 715B. The flat portion 715A may be a flat-plate-shaped portion extending along an X-Y plane. The flat portion 715A is positioned below the halogen heater 713. The flange portions 715B extend downward from respective ends of the flat portion 715A in the sheet conveyance direction F. The reflector 715 may be made of metal, for example, aluminum. The reflector 715 has a mirror-finished portion at at least an upper surface of the flat portion 715A. The upper surface of the flat portion 715A faces the halogen heater 713.

As illustrated in FIGS. 2 and 3, the stay 716 is disposed inside the loop of the fixing belt 711 while being disposed below the reflector 715. The stay 716 may be a steel plate having longer sides extending in the width direction Y. The stay 716 includes a flat portion 716A and flange portions 716B. The flat portion 716A may be a flat-plate-shaped portion extending along the X-Y plane. The flat portion 716A is spaced from and below the flat portion 715A of the reflector 715. The flange portions 716B extend upward toward the reflector 715 from respective ends of the flat portion 716A in the sheet conveyance direction F. Each of the flange portions 716B has an upper end that contacts a lower surface of the flat portion 715A of the reflector 715.

As illustrated in FIGS. 2 and 3, the heat insulator 717 is disposed inside the loop of the fixing belt 711 while covering an outer circumference of the stay 716 from below. The heat insulator 717 may be made of, for example, resin and may have longer sides extending in the width direction Y. The heat insulator 717 includes a flat portion 717A and flange portions 717B. The flat portion 717A may be a flat-plate-shaped portion extending along the X-Y plane. The heat insulator 717 is disposed such that the flat portion 717A contacts a lower surface of the flat portion 716A of the stay 716. The flange portions 717B extend upward toward the reflector 715 from respective ends of the flat portion 717A in the sheet conveyance direction F. The flange portions 717B have respective upper end portions, each of which is positioned between a corresponding one of the flange portions 716B of the stay 716 and a corresponding one of the flange portions 715B of the reflector 715. With this configuration, the reflector 715 is held by the stay 716 and the heat insulator 717.

As illustrated in FIGS. 2 and 3, the nip member 714 extends in the width direction Y and is disposed between a lower surface of the heat insulator 717 and the fixing belt 711. The nip member 714 may be made of metal, for example, aluminum or resin. The nip member 714 includes a base 714A and protrusions 714B. The base 714A may be a flat-plate-shaped portion having longer sides extending in the width direction Y. The base 714A is positioned such that its lower surface faces the inner circumferential surface of the fixing belt 711 at the nip portion P. Each of the protrusions 714B protrudes from the other surface (e.g., an upper surface) of the base 714A that does not face the fixing belt 711. The protrusions 714B are aligned along the width direction Y and spaced apart from each other in the width direction Y. In the illustrative embodiment, as illustrated in FIG. 3, the protrusions 714B are aligned in two rows along the width direction Y and each of the rows includes three of the protrusions 714B aligned along the width direction Y on the upper surface of the base 714A. The rows of the protrusions 714B are positioned side by side in the sheet conveyance direction F. The nip member 714 has recesses 714C in the base 714A. More specifically, for example, each of the recesses 714C is defined in a middle portion of the base 714A in the sheet conveyance direction F and between corresponding pairs of protrusions 714B in the width direction Y. The protrusions 714B in each pair are opposite to each other in the sheet conveyance direction F. The base 714A is an example of nip plate, and the each of the protrusions 714B is an example of a protrusion.

Figure 4:
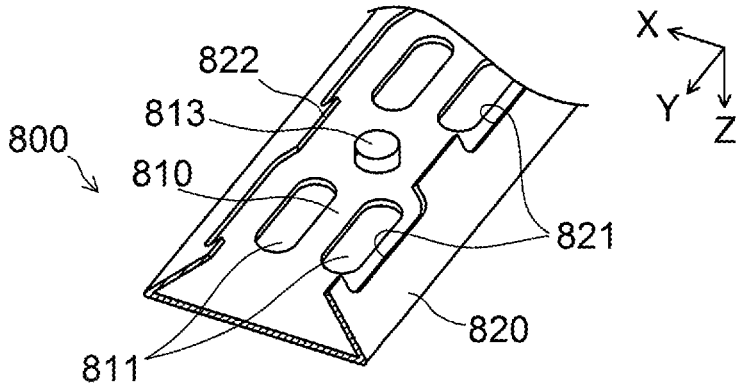
FIG. 4 is a bottom perspective view illustrating a portion of the plate spring in the illustrative embodiment according to one or more aspects of the disclosure.

FIG. 4 is a bottom perspective view illustrating a portion of the plate spring 800. As illustrated in FIGS. 2, 3, and 4, the plate spring 800 may be a plate-shaped member having longer sides extending in the width direction Y. The plate spring 800 is disposed between the heat insulator 717 and the base 714A of the nip member 714. The plate spring 800 may be a bent thin metal plate, e.g., a bent spring steel. More specifically, for example, the plate spring 800 includes a plate portion 810 and folded-back portions 820. The plate portion 810 may be a flat-plate-shaped portion and may extend along the X-Y plane. The plate portion 810 is positioned facing the upper surface of the nip member 714 while being spaced from the base 714A of the nip member 714. The plate portion 810 has a plurality of, for example, six, through holes 811 that penetrate therethrough at locations corresponding to the respective protrusions 714B of the nip member 714. Each of the through holes 811 has a size capable of receiving a corresponding one of the protrusions 714B. As illustrated in FIG. 2, the protrusions 714B of the nip member 714 are positioned in the respective through holes 811 of the plate portion 810 such that the plate portion 810 is movable up and down relative to the protrusions 714B (only two each of the protrusions 714B and the through holes 811 are illustrated in FIG. 2). The plate spring 800 is an example of a spring member, the plate portion 810 is an example of a plate portion, each of the folded-back portions 820 is an example of a spring portion, and each of the through holes 811 is an example of a first through hole.

The plate spring 800 has female portions 813 of press fasteners in the plate portion 810. More specifically, for example, each of the female portions is defined in a middle portion of the plate portion 810 in the sheet conveyance direction F and between corresponding pairs of through holes 811 in the width direction Y. The through holes 811 in each pair are opposite to each other in the sheet conveyance direction F. Each of the female portions 813 has a lower end portion that protrudes downward relative to a lower surface of the plate portion 810. The plate portion 810 has pairs of recesses 812 in its upper surface. A single pair of recesses 812 is positioned each upstream and downstream of each of the female portions 813 in the sheet conveyance direction F. The recesses 812 in each pair are positioned side by side in the width direction Y.

The folded-back portions 820 extend downwardly toward the nip member 714 from respective ends of the plate portion 810 in the sheet conveyance direction F. When viewed in the width direction Y, directions that the respective folded-back portions 820 extend are angled relative to the pressing direction N. More specifically, for example, an angle which each of the folded-back portions 820 forms with the plate portion 810 is acute. In other words, a distance between the folded-back portions 820 decreases toward their distal ends.

As illustrated in FIG. 4, each of the folded-back portions 820 has a plurality of cutouts 821 and a plurality of projecting portions 822 at its distal end portion along the width direction Y alternately. Each of the projecting portions 822 contacts the base 714A of the nip member 714. Each of the projecting portions 822 is positioned between corresponding adjacent two of the through holes 811 in the width direction Y. In other words, each of the projecting portions 822 is located so as not to overlap any of the through holes 811 in the width direction Y. Each of the cutouts 821 does not contact the base 714A of the nip member 714 and is located so as to coincide with a corresponding one of the through holes 811 in the width direction Y. In a direction orthogonal to the width direction Y, each of the folded-back portions 820 has a first dimension D1 and a second dimension D2. The first dimension D1 corresponds to a distance between a proximal end of the folded-back portion 820 and a bottom edge of a cutout 812. The second dimension D2 corresponds to a distance between the proximal end of the folded-back portion 820 and a distal end of a projecting portion 822. The first dimension D1 may be shorter than or equal to a dimension D3. The dimension D3 correspond to the shortest distance between one of the ends of the plate portion 810 in the sheet conveyance direction F and an edge of the through hole that is closest to the one end of the plate portion 810. That is, in a state where each of the folded-back portions 820 forms the smallest angle with the plate portion 810, that is, in a state where the plate spring 800 is elastically deformed at its maximum, the folded-back portions 820 do not overlap any of the through holes 811 when viewed in the pressing direction N. This configuration may therefore restrict interference between the plate spring 800 and the protrusions 714B of the nip member 714.

As illustrated in FIGS. 2 and 3, the sliding sheet 900 may have a substantially rectangular shape having longer sides extending in the width direction Y. The sliding sheet 900 has end portions (hereinafter, referred to as longer-side end portions) and a central portion in the sheet conveyance direction F. The central portion is defined between the longer-side end portions in the sheet conveyance direction F. The sliding sheet 900 may be made of, for example, grass fiber, stainless steel, mesh, or carbon cloth. While the sliding sheet 900 is shorter in length than the plate portion 810 of the plate spring 800 in the width direction Y, the sliding sheet 900 is longer in length than the plate portion 810 of the plate spring 800 in the sheet conveyance direction F.

The sliding sheet 900 has a plurality of, for example, three, through holes 910 penetrating in each of the longer-side end portions. The through holes 910 defined in each of the longer-side end portions are spaced apart from each other in the width direction Y. The through holes 910 are larger in size than the through holes 811 of the plate portion 810. Each of the through holes 910 is an example of a second through hole. The sliding sheet 900 further includes a plurality of, for example, two, first tabs 920 at one of the longer-side end portions. Each of the first tabs 920 protrudes relative to one of longer-side ends of the sliding sheet 900 in the sheet conveyance direction F. The first tabs 920 are spaced apart from each other in the width direction Y. Each of the first tabs 920 is positioned between corresponding adjacent two of the through holes 910 in the sheet conveyance direction F. Each of the first tabs 920 includes a male portion 930 of the press fasteners. The male portion 930 is configured to engage the female portion 813 of the press fasteners. The sliding sheet 900 further includes, a plurality of, for example, two, second tabs 940 at the other of the longer-side end portions. Each of the second tabs 940 protrudes relative to the other of the longer-side ends of the sliding sheet 900 in the sheet conveyance direction F. The second tabs 940 are spaced apart from each other in the width direction Y. Each of the second tabs 940 is positioned between corresponding adjacent two of the through holes 910 in the sheet conveyance direction F. Each of the second tabs 940 has a through hole 950 penetrating therethrough. The through hole 950 is an example of a third through hole.

Figure 5:
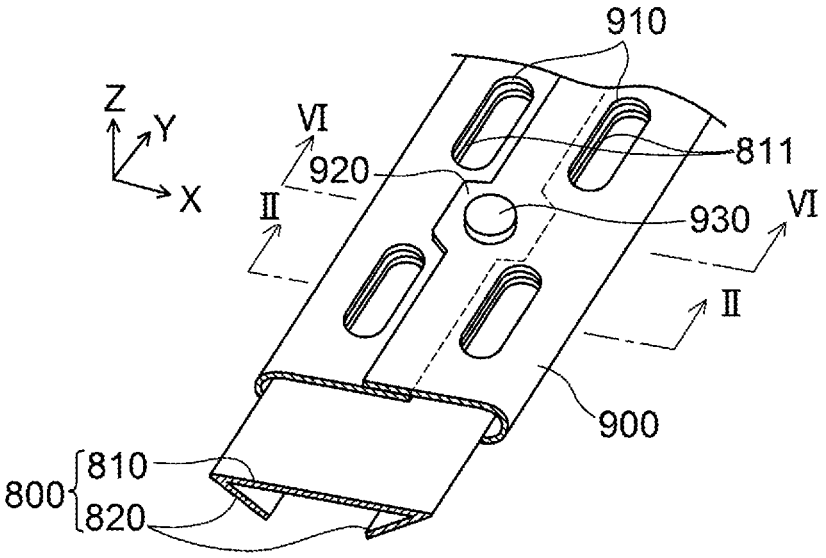
FIG. 5 is a top perspective view illustrating an assembly of the plate spring and the sliding sheet in the illustrative embodiment according to one or more aspects of the disclosure.
Figure 6A:
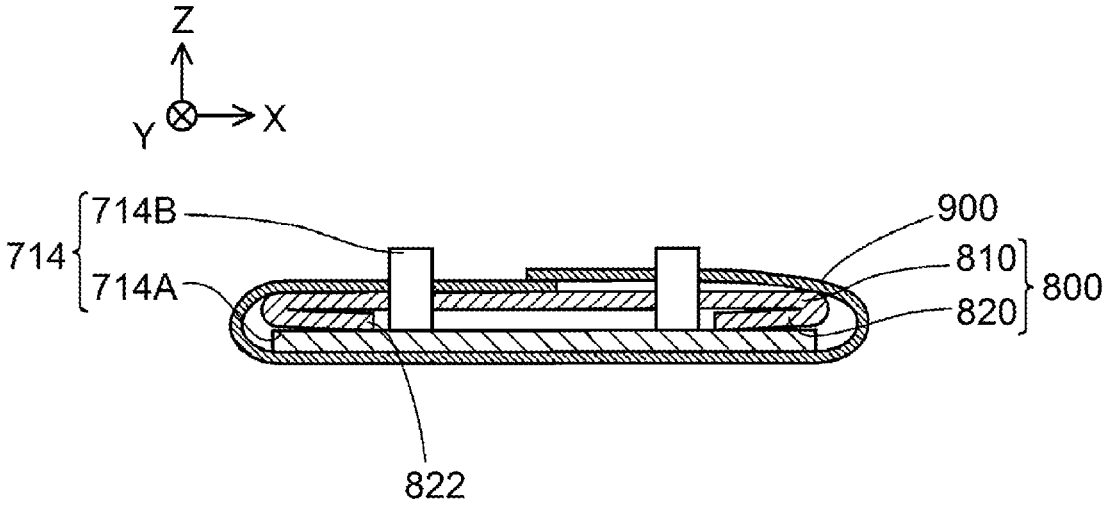
FIG. 6A illustrates an X-Z section configuration of the nip member, the plate spring, and the sliding sheet taken along line II-II of FIG. 5 in the illustrative embodiment according to one or more aspects of the disclosure.
Figure 6B:
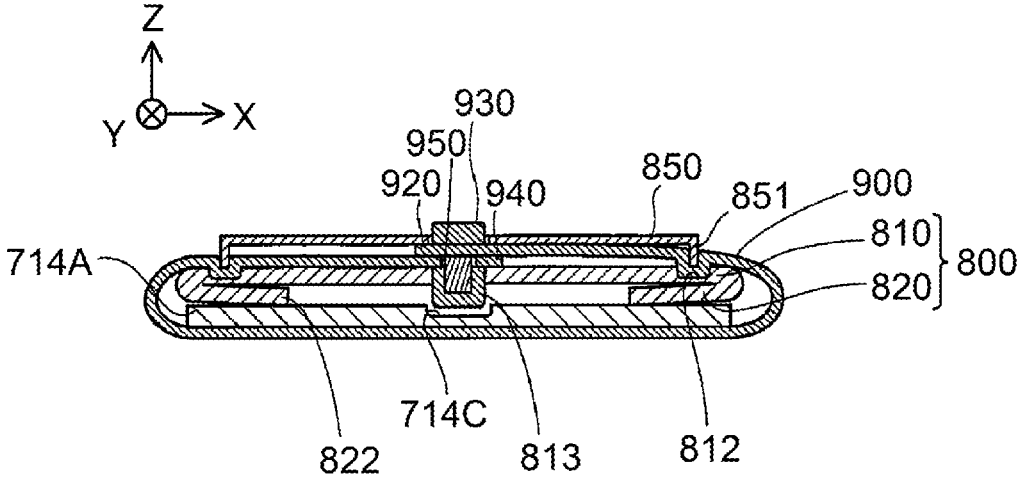
FIG. 6B illustrates an X-Z section configuration of the nip member, the plate spring, the sliding sheet, and one of retainers taken along line VI-VI of FIG. 5 in the illustrative embodiment according to one or more aspects of the disclosure.

FIG. 5 is a top perspective view illustrating an assembly of the plate spring 800 and the sliding sheet 900. FIG. 6A illustrates an X-Z section configuration of the nip member 714, the plate spring 800, and the sliding sheet 900 taken along line II-II of FIG. 5. FIG. 6B illustrates an X-Z section configuration of the nip member 714, the plate spring 800, the sliding sheet 900, and one of the retainers 850 taken along line VI-VI of FIG. 5. In FIG. 5, the nip member 714 and the retainers 850 are omitted from the drawing. FIGS. 6A and 6B each illustrate a state where the angle formed by the plate portion 810 and each of the folded-back portions 820 of the plate spring 800 is minimum which may be smaller than the angle formed when the folded-back portions 820 are in their natural state, that is, FIGS. 6A and 6B each illustrate a state where the plate spring 800 is elastically deformed at its maximum.

As illustrated in FIGS. 2, 5, 6A, and 6B, the central portion of the sliding sheet 900 is positioned below the base 714A of the nip member 714. The longer-side end portions of the sliding sheet 900 are folded back toward the heat insulator 717 at respective portions thereof corresponding to respective ends of the base 714A in the sheet conveyance direction F and are fastened to the upper surface of the plate spring 800. The upper surface of the plate spring 800 is an example of the facing surface of the spring member. More specifically, for example, the second tabs 940 of the sliding sheet 900 are positioned above the female portions 813 of the press fasteners of the plate portion 810 of the plate spring 800 and the first tabs 920 of the sliding sheet 900 overlap the respective second tabs 940 from above. The male portions 930 of the press fasteners of the respective first tabs 920 are engaged with the respective corresponding female portions 813 of the press fasteners of the plate spring 800 via the respective through holes 950 of the second tabs 940. Thus, the sliding sheet 900 is fastened to the plate portion 810 of the plate spring 800. As illustrated in FIG. 6B, each of the female portions 813 that protrude downward relative to the lower surface of the plate portion 810 of the plate spring 800 is positioned in a corresponding one of the recesses 714C defined in the upper surface of the base 714A of the nip member 714. Therefore, this configuration may avoid interference between the female portions 813 and the nip member 714 and may also reduce the height of the internal configuration of the rotary heating unit 710.

As illustrated in FIGS. 2 and 6B, in a state where the male portions 930 and the female portions 813 of the press fasteners are engaged with each other, the projecting portions 822 are elastically deformed by application of force from the sliding sheet 900 in the top-bottom direction, and the angle formed by the plate portion 810 and each of the folded-back portions 820 is smaller than the angle formed when the folded-back portions 820 are in their natural state (refer to FIGS. 3 and 4). Therefore, the projecting portions 822 urge the plate portion 810 of the plate spring 800 in a direction away from the nip member 714 due to their restoring force, whereby the sliding sheet 900 is held under tension by the restoring force applied to the plate portion 810. More specifically, for example, a force pulling along the sheet conveyance direction F is applied to the portion of the sliding sheet 900 sandwiched between the nip member 714 and the fixing belt 711. The projecting portions 822 are examples of first and second spring legs and each of the folded-back portions 820 is an example of the spring portion.

As illustrated in FIG. 3, each of the retainers 850 may be a plate-shaped member having longer sides extending in the sheet conveyance direction F. Each of the retainers 850 includes a pair of retaining claws 851 at each end portion thereof in the sheet conveyance direction F. The retaining claws 851 in each pair are positioned side by side in the width direction Y and protrude downward. As illustrated in FIG. 6B, each of retaining claws 851 is engaged with a corresponding one of the recesses 812 of the plate portion 810 of the plate spring 800 via the sliding sheet 900. Through this engagement, the longer-side end portions of the sliding sheet 900 are fastened to the plate portion 810 of the plate spring 800 firmly. In a state where the sliding sheet 900 is fastened to the plate spring 800, the protruding male portions 930 of the press fasteners are positioned in respective through holes of the retainers 850. This configuration may avoid interference between the male portions 930 of the press fasteners and the retainers 850.

According to the illustrative embodiment, the sliding sheet 900 is fastened to the plate portion 810 of the plate spring 800, and the plate portion 810 is urged in the direction away from the nip member 714 by the projecting portions 822 of the folded-back portions 820. With this configuration, therefore, tension is applied to the sliding sheet 900 in the sheet conveyance direction F. In other words, the central portion of the sliding sheet 900 is always pulled by the longer-side end portions of the sliding sheet 900, more specifically, by the first and second tabs 920 and 940. Therefore, this configuration may reduce occurrence of creases or wrinkles in the central portion of the sliding sheet 900. In the illustrative embodiment, the plate spring 800 is positioned between the stay 716 and the nip member 714. Therefore, as compared with a case where the plate portion and the spring portion are disposed upstream or downstream of the nip member 714 in the sheet conveyance direction F, the outside diameter of the fixing belt 711 may be reduced and therefore the fixing device 700 may be reduced in size.

The through holes 811 of the plate portion 810 are engaged with the respective protrusions 714B of the nip member 714. This configuration may reduce a positional deviation between the plate spring 800 and the nip member 714. The sliding sheet 900 has the through holes 910 for engaging the respective protrusions 714B of the nip member 714. With this configuration, the through holes 910 of the sliding sheet 900 are engaged with the respective protrusions 714B, whereby the sliding sheet 900 may be further surely fastened to the plate portion 810 of the plate spring 800.

The plate spring 800 includes the plate portion 810 as the plate portion and the projecting portion 822 as the spring portion that are in one piece and inseparable from each other. Therefore, as compared with a case where the plate portion and the spring portion are separate members, this configuration may enable reduction of the parts count. When viewed in the width direction Y, the projecting portions 822 are angled relative to the pressing direction N and the projecting portions 822 urge the plate portion 810 in the direction away from the nip member 714 by their restoring force occurring due to elastic deformation of the projecting portions 822. As described above, the spring portion may be provided readily in the plate spring 800 by bending. In the illustrative embodiment, the plate spring 800 includes the folded-back portions 820 at the respective ends thereof in the sheet conveyance direction F. Therefore, as compared with a case where the plate spring 800 includes only one of the folded-back portions 820 at one of the ends thereof in the sheet conveyance direction F, this configuration may enable the plate portion 810 to move always in the pressing direction N.

The first tabs 920 of the one of the longer-side end portions of the sliding sheet 900 and the second tabs 940 of the other of the longer-side end portions of the sliding sheet 900 are both fastened to the plate portion 810 of the plate spring 800. That is, the upstream end portion and the downstream end portion of the sliding sheet 900 in the sheet conveyance direction F are both fastened to the plate portion 810 of the plate spring 900. Therefore, as compared with a case where only either one of the longer-side end portions of the sliding sheet 900 is fastened to the plate portion 810, this configuration may enable uniform application of tension to the sliding sheet 900. In the illustrative embodiment, the first tabs 920 and the second tabs 940 of the sliding sheet 900 are fastened to the plate portion 810 with overlapping each other. Therefore, as compared with a case where the first tabs 920 and the second tabs 940 of the sliding sheet 900 are fastened to the plate portion 810 at respective different positions without overlapping each other, this configuration may enable reduction of the parts count.

The plate portion 810 of the plate spring 800 is longer in length than the sliding sheet 900 in the width direction Y. As illustrated in FIG. 5, the ends of the plate portion 810 in the width direction Y protrude relative to the respective ends of the sliding sheet 900 in the width direction Y. Therefore, at the time of wrapping the sliding sheet 900 around the plate spring 800 and the nip member 714, this configuration may enable the sliding sheet 900 to be fastened to the plate portion 810 readily while side end portions of the plate portion 810 in the sheet conveyance direction F are pressed downward to deform the projecting portions 822 elastically.

Using the retainers 850 may enable the firm fastening of the sliding sheet 900 to the plate portion 810. In the illustrative embodiment, the stay 716 and the heat insulator 717 are positioned between the halogen heater 713 and the plate spring 800. Therefore, this configuration may enable reduction of heat transfer from the halogen heater 713 to the plate spring 800, which may further reduce deterioration of the plate spring 800 and the sliding sheet 900 due to exposure to heat.

In the illustrative embodiment, the sliding sheet 900 is fastened to the plate spring 800 by engagement of the male portions 930 and the female portions 813 of the press fasteners. Therefore, this configuration might not necessarily require use of adhesive for fastening the sliding sheet 900 to the plate spring 800.

Figure 7:
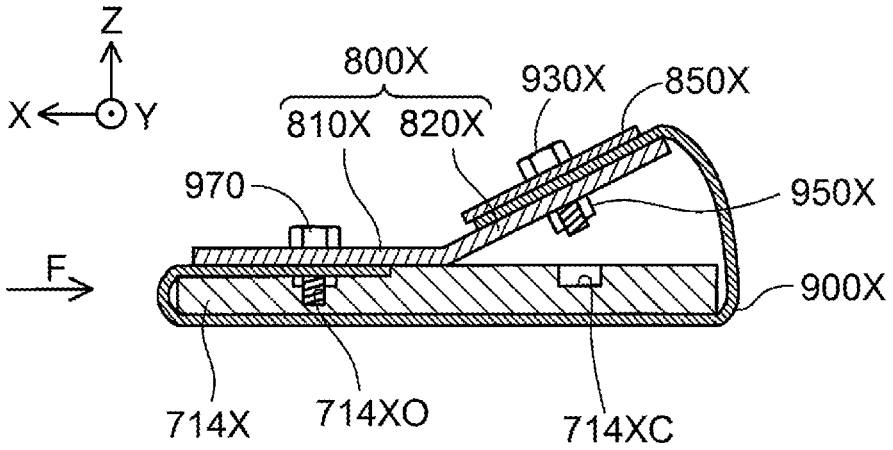
FIG. 7 illustrates an X-Z section configuration of a nip member, a plate spring, a sliding sheet, and a retainer in an alternative embodiment according to one or more aspects of the disclosure.

FIG. 7 illustrates an X-Z section configuration of a nip member 714X, a plate spring 800X, a sliding sheet 900X, and a retainer 850X in an alternative embodiment. An explanation will be given mainly for the parts different from the illustrative embodiment, and an explanation will be omitted for the common parts by assigning the same reference numerals thereto. The plate spring 800X is another example of the spring member.

As illustrated in FIG. 7, the nip member 714X may be a flat-plate-shaped member. The nip member 714X has a screw hole 714XO. The screw hole 714XO is defined in an upstream portion of an upper surface of the nip member 714X in the sheet conveyance direction F. The nip member 714X further has a recess 714XC. The recess 714XC is defined in a downstream portion of the upper surface of the nip member 714X in the sheet conveyance direction F. The plate spring 800X may be a bent thin metal plate, e.g., a bent spring steel. More specifically, the plate spring 800X includes a first portion 810X and a second portion 820X. The first portion 810X may be a flat-plate-shaped portion extending substantially parallel to the nip member 714X. The first portion 810X is positioned on the upstream portion of the upper surface of the nip member 714X. The first portion 810X is fastened to the nip member 714X by a screw 970 having a tip portion which is screwed in the screw hole 714XO through a hole defined in the first portion 810X. An upstream end portion of the sliding sheet 900X in the sheet conveyance direction F is fastened with being sandwiched between the first portion 810X and the nip member 714X. More specifically, the sliding sheet 900X has a through hole through which the screw 970 passes, in one of longer-side end portions thereof. The screw 970 fastens the first portion 810X of the plate spring 800X to the nip member 714 via the through hole of the sliding sheet 900X.

When viewed in the width direction Y, the second portion 820X of the plate spring 800X is angled relative to the pressing direction N and is spaced apart from the upper surface of the nip member 714X. A downstream end portion of the sliding sheet 900X in the sheet conveyance direction F is positioned on an upper surface of the second portion 820X of the plate spring 800X and the plate-shaped retainer 850X are positioned on the downstream end portion of the sliding sheet 900X. In this state, a screw 930X is screwed in a nut 950X via a through hole of the sliding sheet 900X and a through hole of the second portion 820X of the plate spring 800X. The nut 950X is positioned on a lower surface side of the second portion 820X of the plate spring 800X. Thus, the downstream end portion of the sliding sheet 900X is fastened with being sandwiched between the second portion 820X of the plate spring 800X and the retainer 850X. In this state, the downstream end portion of the second portion 820X is elastically deformed downward and thus the sliding sheet 900 X is held under tension by restoring force of the second portion 820X of the plate spring 800X. More specifically, for example, the downstream portion of the sliding sheet 900 in the sheet conveyance direction F is applied with greater tension than tension applied to the upstream portion of the sliding sheet 900 in the sheet conveyance direction F. The second portion 820X is another example of the plate portion and another example of the spring portion.

The sliding sheet 900X is pulled along the sheet conveyance direction F in response to rotation of the fixing belt 713. In a case where the sliding sheet 900 becomes non-contractile, therefore, the sliding sheet 900 becomes loose and the loose portion may tend to gather at a location downstream of the nip member 714X in the sheet conveyance direction F. According to the illustrative embodiment, the upstream end portion of the sliding sheet 900X in the sheet conveyance direction F is fastened to the nip member 714X and the downstream end portion of the sliding sheet 900X in the sheet conveyance direction F is fastened to the second portion 820X of the plate spring 800X. Therefore, tension may be applied to the downstream end portion of the sliding sheet 900X rather than the upstream end portion thereof. Therefore, this configuration may reduce or restrict the sliding sheet 900 from becoming loose and the loose portion from gathering at its portion downstream of the nip member 714X in the sheet conveyance direction F.

The nip member 714X further includes a plurality of protrusions 714B similar to the nip member 714. Therefore, the plate spring 800X is positioned in one of spaces, each of which is provided between the pairs of protrusions 714B in the width direction Y. That is, the plate spring 800X has a smaller dimension in the width direction Y than the distance (e.g., the space) between adjacent protrusions 714B in the width direction Y. In this case, it is preferable that a plurality of plate springs 800X are disposed in the width direction Y. More specifically, a single plate spring 800X may be disposed in each of the spaces provided between the pairs of protrusions 714B in the width direction Y.

Figure 8:
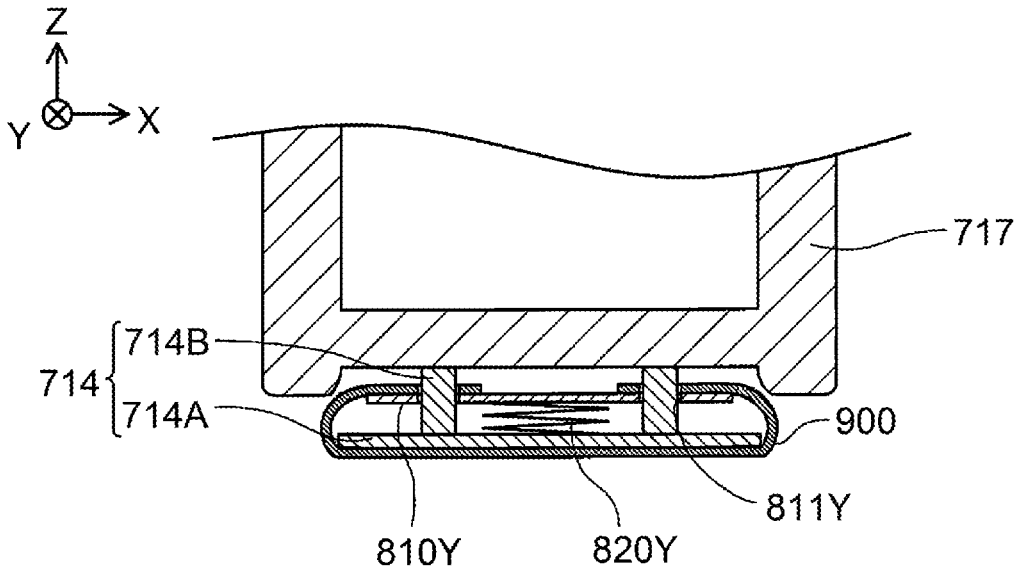
FIG. 8 illustrates an X-Z section configuration of a nip member, a plate portion, a coil spring, and a sliding sheet in another alternative embodiment according to one or more aspects of the disclosure.

FIG. 8 illustrates an X-Z section configuration of the nip member 714, a plate portion 810Y, a coil spring 820Y, and the sliding sheet 900 in another alternative embodiment. An explanation will be given mainly for the parts different from the illustrative embodiment, and an explanation will be omitted for the common parts by assigning the same reference numerals thereto.

As illustrated in FIG. 8, a flat-plate-shaped plate portion 810Y having longer sides extending in the width direction Y is disposed between the base 714A of the nip member 714 and the heat insulator 717. The plate portion 810Y has through holes 811Y. Each of the through holes 811W is another example of the first through hole. The protrusions 714B of the nip member 714 are positioned in the respective through holes 811Y. The coil spring 820Y is disposed between the base 714A of the nip member 714 and the plate portion 810Y in a compressed state. Due to restoring force of the coil spring 820Y, the plate portion 810Y is urged in a direction away from the nip member 714. Since the plate portion 810Y and the coil spring 820Y are separate members, the plate portion 810Y and the coil spring 820Y may be made of respective different materials appropriate for their respective functions. In other embodiments, for example, a plurality of coil springs 820Y may be disposed between the base 714A of the nip member 714 and the plate portion 810Y. The coil spring 820Y is another example of the spring member, the plate portion 810Y is another example of the plate portion, and the combination of the plate portion 810Y and the coil spring 820Y is another example of the spring member.

Figure 9:
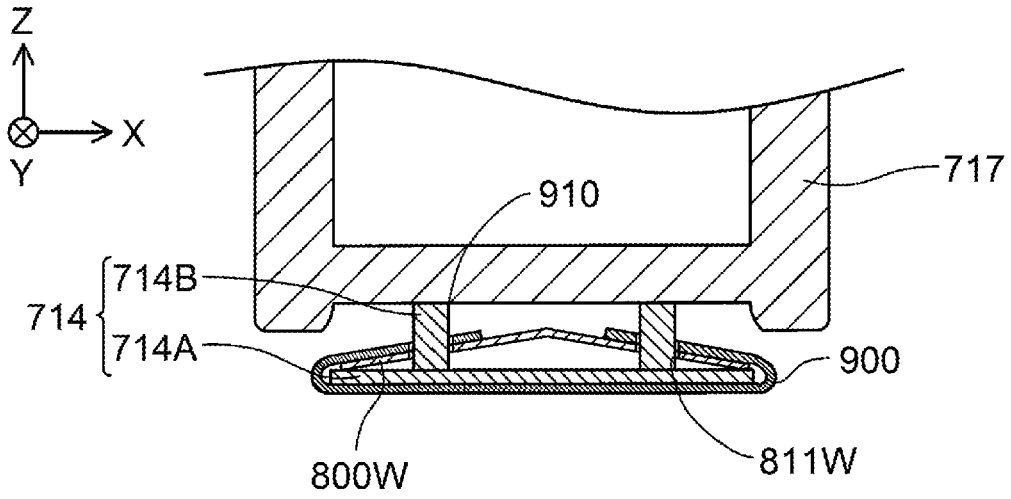
FIG. 9 illustrates an X-Z section configuration of a nip member, a plate spring, and a sliding sheet in still another alternative embodiment according to one or more aspects of the disclosure.

FIG. 9 illustrates an X-Z section configuration of the nip member 714, a plate spring 800W, and a sliding sheet 900 in still another alternative embodiment. An explanation will be given mainly for the parts different from the illustrative embodiment, and an explanation will be omitted for the common parts by assigning the same reference numerals thereto.

As illustrated in FIG. 9, the plate spring 800W may be a bent thin metal plate, e.g., a bent spring steel. More specifically, for example, a metal plate is folded in half to provide the plate spring 800W having a shape such that a bend is positioned farther from the base 714A of the nip member 714 than end portions of the plate spring 800W in the sheet conveyance direction F. The plate spring 800W has through holes 811W. The protrusions 714B of the nip member 714 are positioned in the respective through holes 811W. Each of the through holes 811W has a dimension greater than a corresponding one of the protrusions 714B in the sheet conveyance direction F. The sliding sheet 900 is positioned such that its central portion faces the lower surface of the base 714 of the nip member 714. The longer-side end portions of the sliding sheet 900 are folded back onto an upper surface of the plate spring 800W and are fastened thereto. In this state, the plate spring 800W is elastically deformed such that the bend of the plate spring 800W forms a larger angle than the angle of the bend when the plate spring 800W is in its natural state. Thus, the sliding sheet 900 is under tension by resorting force of the plate spring 800W. The plate spring 800W is another example of the spring member, and each of the through holes 811W is another example of the first through hole.

According to this alternative embodiment, the plate portion and the spring portion may be provided by an extremely simple process (e.g., folding a metal plate in half).

While the disclosure has been described in detail with reference to the specific embodiments thereof, these are merely examples, and various changes, arrangements and modifications may be applied therein without departing from the spirit and scope of the disclosure.

In other embodiments, for example, a plurality of plate springs may be provided. In this case, each of the plate springs may have a width substantially equal to or shorter than the width of the space between corresponding pairs of protrusions 714B of the nip member 714 in the width direction Y. The protrusions 714B in each pair are opposite to each other in the sheet conveyance direction F. Each of the plate springs may be disposed in a corresponding one of the spaces therebetween.

In other embodiments, for example, the sliding sheet 900 may be fastened to the plate spring 800 or the nip member 714 by swaging or using staples, as well as the press fasteners or screws. In another example, adhesive may be used for fastening the sliding sheet 900 to the plate spring 800 or the nip member 714.

In other embodiments, for example, the distance between the folded-back portions 820 of the plate spring 800 may increase toward the distal ends of the folded-back portions 820. In other embodiments, for example, the plate spring 800 may include either one of the folded-back portions 820 only. In other embodiments, for example, the folded-back portions 820 may extend downward toward the nip member 714 from respective ends of the plate portion 810 in the width direction Y.

In the illustrative embodiment, each of the through holes 811 is defined by an endless edge. Nevertheless, in other embodiments, for example, each through hole may be defined by an edge having ends that might not be joined if each of the through holes is capable of engaging a corresponding protrusion 714B of the nip member 714 against restring force of the plate spring 800.

In other embodiments, for example, each of the retainers 850 may include the male portion of the press fasteners. In this case, the male portion of each of the retainers 850 may be engaged with a corresponding one of the female portions 813 of the press fasteners of the plate spring 800 via a through hole (not illustrated) of the first tab 920 and the through hole 950 of the second tab 940. Through the engagement of the male portions and the respective female portions of the press fasteners, the longer-side end portions of the sliding sheet 900 may be fastened to the nip member 714. In other embodiments, for example, the plate spring 800 may have the male portions of the press fasteners and each of the first tabs 920 of the sliding sheet 900 or each of the retainers 850 may have the female portion of the press fasteners.

The printer 10 is an example of an image forming apparatus including the fixing device 700. In the illustrative embodiment, the printer 10 performs printing using toner of a single color (e.g., black). Nevertheless, the toner colors and the number of toner colors are not limited to the specific example. In other embodiments, for example, the image forming apparatus may include copying machines, facsimile machines, and multifunction devices as well as printers. The disclosure may be applied to those devices. The fixing device 700 may be included in any device as well as the image forming apparatus.

In the illustrative embodiment, the halogen heater 713 is taken as an example of the heater of the fixing device. Nevertheless, in other embodiments, for example, the heater may be an infrared heater or a carbon heater. The heater may be disposed outside the loop of the endless belt.

What is claimed is:

1. A fixing device, comprising:

an endless belt;

a roller being in contact with an outer surface of the endless belt;

a nip plate disposed in the endless belt;

a supporting member disposed in the endless belt and supporting the nip plate;

a spring member disposed in the endless belt between the nip plate and the supporting member, the spring member urged in a first direction away from the nip plate toward the supporting member;

a sliding sheet having a first surface and a second surface opposite the first surface, the sliding sheet being nipped with the endless belt between the nip plate and the roller, the first surface being in contact with an inner surface of the endless belt and the second surface of the sliding sheet being in contact with the nip plate; and a protrusion extending from the nip plate through the spring member in the first direction and contacting the supporting member;

wherein the sliding sheet is fastened to a facing surface of the spring member that is facing toward the supporting member and away from the nip plate, and the second surface contacts the spring member.

2. The fixing device as claimed in claim 1, wherein the protrusion further extends through the sliding sheet.

3. The fixing device as claimed in claim 1, wherein the spring member includes a plate portion urged in the first direction, the plate portion including the facing surface.

4. The fixing device as claimed in claim 3, wherein the spring member includes a spring portion positioned between the plate portion and the nip plate.

5. The fixing device as claimed in claim 4, further comprising:

a plurality of protrusions extending from the nip plate through the spring member in the first direction and contacting the supporting member, the plurality of protrusions including two adjacent protrusions spaced apart along a second direction parallel to an axis of rotation of the endless belt;

wherein the spring portion is neighbored by the two adjacent protrusions of the plurality of protrusions.

6. The fixing device as claimed in claim 4, wherein the plate portion is integrated with the spring portion.

7. The fixing device as claimed in claim 1, further comprising:

a plurality of first protrusions extending from the nip plate through the spring member in the first direction and contacting the supporting member, the plurality of first protrusions spaced apart from each other and arrayed in a second direction parallel to an axis of rotation of the endless belt; and a plurality of second protrusions extending from the nip plate through the spring member in the first direction and contacting the supporting member, the plurality of second protrusions spaced apart from each other and arrayed in the second direction, the plurality of second protrusions spaced apart from the plurality of first protrusions in a third direction perpendicular to the first direction and the second direction, wherein the spring member includes:

a plate portion including the facing surface;

a plurality of first spring legs extending from a first end of the plate portion, each of the first spring legs contacting the nip plate; and a plurality of second spring legs extending from a second end of the plate portion, each of the second spring legs contacting the nip plate, and the first and second ends being opposite ends of the plate portion in the third direction;

wherein the plurality of first spring legs are positioned alternately with the first protrusions in the second direction and the plurality of second spring legs are positioned alternately with the second protrusions in the second direction.

8. The fixing device as claimed in claim 7, wherein the plurality of first spring legs are included in a first spring portion extending from the first end of the plate portion along a length of the plate portion, the plurality of first spring legs extending a first distance from the first end of the plate portion, the first spring portion including first regions between the plurality of first spring legs that extend a second distance from the first end of the plate portion that is shorter than the first distance; and wherein the plurality of second spring legs are included in a second spring portion extending from the second end of the plate portion along the length of the plate portion, the plurality of second spring legs extending the first distance from the second end of the plate portion, the second spring portion including second regions between the plurality of second spring legs that extend the second distance from the second end of the plate portion.

9. The fixing device as claimed in claim 1, wherein the sliding sheet is shaped rectangularly and includes first and second end portions, each of the first and second end portions extending along a second direction parallel to an axis of rotation of the endless belt and being spaced apart from each other in a third direction perpendicular to the first direction and the second direction, and wherein at least one of the first and second end portions is fastened to the facing surface of the spring member.

10. The fixing device as claimed in claim 9, wherein the first and second end portions are fastened to the facing surface of the spring member with the first end portion overlapping the second end portion.

11. The fixing device as claimed in claim 10, wherein one of the first and second end portions includes a male portion of a press fastener that passes through the other of the first and second end portions, and wherein the spring member includes a female portion of the press fastener corresponding to the male portion.

12. The fixing device as claimed in claim 9, wherein the first end portion is fastened to the nip plate and the second end portion is fastened to the facing surface of the spring member, the first end portion extending over a upstream edge of the nip plate.

13. The fixing device as claimed in claim 1, wherein a length of the spring member in a second direction parallel to an axis of rotation of the endless belt is longer than a length of the sliding sheet in the second direction.

14. The fixing device as claimed in claim 1, further comprising a retainer disposed between the spring member and the supporting member in the first direction, wherein the retainer holds the sliding sheet together with the spring member.

15. The fixing device as claimed in claim 14, wherein the retainer includes a plurality of retaining claws at opposite ends in a third direction, the third direction being perpendicular to the first direction and a second direction parallel to an axis of rotation of the endless belt, and wherein each of the retaining claws protrudes toward the spring member and is engaged with the sliding sheet at a corresponding one of a plurality of recesses in the spring member.

16. The fixing device as claimed in claim 1, wherein the spring member comprises at least one of a plate spring and a coil spring.

17. A fixing device, comprising:

an endless belt;

a roller being in contact with an outer surface of the endless belt;

a nip plate disposed in the endless belt;

a supporting member disposed in the endless belt and supporting the nip plate;

a spring member disposed in the endless belt between the nip plate and the supporting member, the spring member urged in a first direction away from the nip plate toward the supporting member; and a sliding sheet having a first surface and a second surface opposite the first surface, the sliding sheet being nipped with the endless belt between the nip plate and the roller, the first surface being in contact with an inner surface of the endless belt and the second surface of the sliding sheet being in contact with the nip plate;

wherein the sliding sheet is fastened to a facing surface of the spring member that is facing toward the supporting member and away from the nip plate, and the second surface contacts the spring member, wherein the sliding sheet is shaped rectangularly and includes first and second end portions, each of the first and second end portions extending along a second direction parallel to an axis of rotation of the endless belt and being spaced apart from each other in a third direction perpendicular to the first direction and the second direction, and wherein the first and second end portions are fastened to the facing surface of the spring member with the first end portion overlapping the second end portion.

18. The fixing device as claimed in claim 17, wherein one of the first and second end portions includes a male portion of a press fastener that passes through the other of the first and second end portions, and wherein the spring member includes a female portion of the press fastener corresponding to the male portion.

19. A fixing device, comprising:

an endless belt;

a roller being in contact with an outer surface of the endless belt;

a nip plate disposed in the endless belt;

a supporting member disposed in the endless belt and supporting the nip plate;

a spring member disposed in the endless belt between the nip plate and the supporting member, the spring member urged in a first direction away from the nip plate toward the supporting member; and a sliding sheet having a first surface and a second surface opposite the first surface, the sliding sheet being nipped with the endless belt between the nip plate and the roller, the first surface being in contact with an inner surface of the endless belt and the second surface of the sliding sheet being in contact with the nip plate;

wherein the sliding sheet is fastened to a facing surface of the spring member that is facing toward the supporting member and away from the nip plate, and the second surface contacts the spring member, and wherein a length of the spring member in a second direction parallel to an axis of rotation of the endless belt is longer than a length of the sliding sheet in the second direction.

20. The fixing device as claimed in claim 19, wherein the sliding sheet is shaped rectangularly and includes first and second end portions, each of the first and second end portions extending along a second direction parallel to an axis of rotation of the endless belt and being spaced apart from each other in a third direction perpendicular to the first direction and the second direction, and wherein the first and second end portions are fastened to the facing surface of the spring member with the first end portion overlapping the second end portion.

* * * * *